United States Patent [19]

Crosby

[11] 4,306,391

[45] Dec. 22, 1981

[54] MODULAR BUILDING PANEL

[76] Inventor: Samuel C. Crosby, 5304 Panola Industrial Blvd., Decatur, Ga. 30035

[21] Appl. No.: 44,218

[22] Filed: May 31, 1979

[51] Int. Cl.[3] ..... E04H 1/00

[52] U.S. Cl. ..... 52/79.4; 52/236.2; 52/DIG. 10; 52/80

[58] Field of Search ..... 52/80, 79.4, 236.2, 52/DIG. 10; D25/4, 32

[56] References Cited

U.S. PATENT DOCUMENTS

| | | | |
|---|---|---|---|
| 3,533,202 | 10/1970 | Gellert | D25/4 X |
| 3,663,347 | 5/1972 | Schoen | 52/80 X |
| 3,931,697 | 1/1976 | Pearce | 52/79.4 X |

FOREIGN PATENT DOCUMENTS

| | | | |
|---|---|---|---|
| 1517685 | 3/1968 | France | 52/79.4 |

OTHER PUBLICATIONS

Photocopy of Photograph from Auburn Design, 1965, cited in Affidavit by Applicant.

*Primary Examiner*—Carl D. Friedman
*Attorney, Agent, or Firm*—Arnold, White & Durkee

[57] ABSTRACT

A modular building panel is disclosed which is suitable for arrangement with other identical panels to form the side walls for an enclosed structure. The panel includes a wall having a uniform thickness such that the wall extends from a first end having a circle quadrant configuration to a second end formed by a pair of converging surfaces that blend into arcs that form a region that can be used, for example, as an archway.

13 Claims, 9 Drawing Figures

FIG. 1
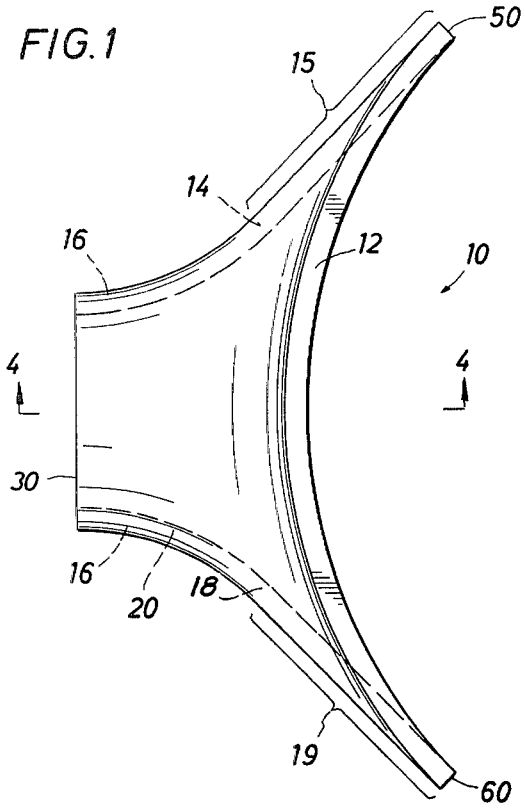
FIG. 2
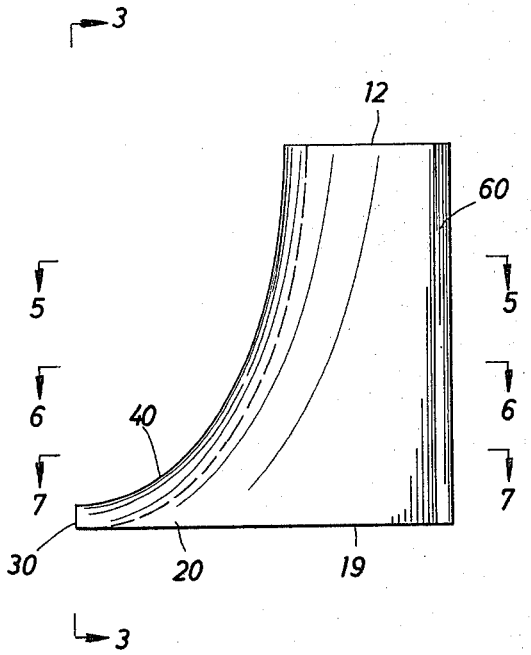
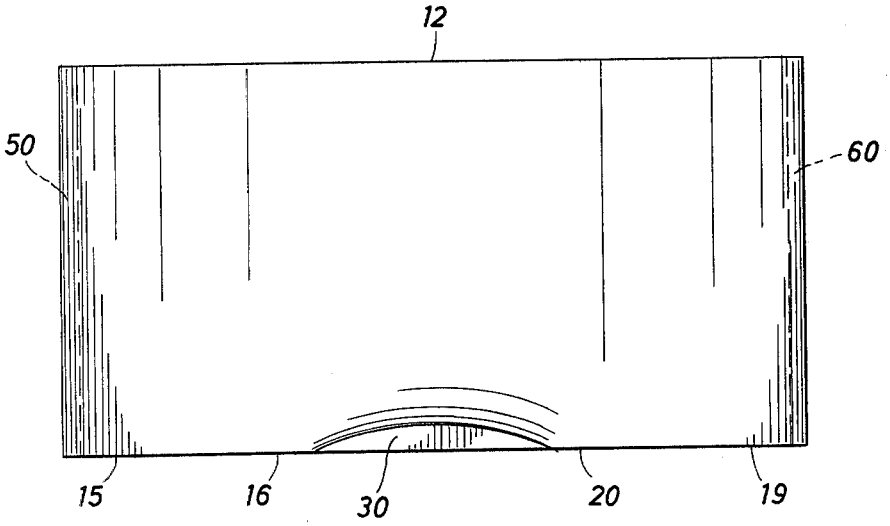
FIG. 3
FIG. 4
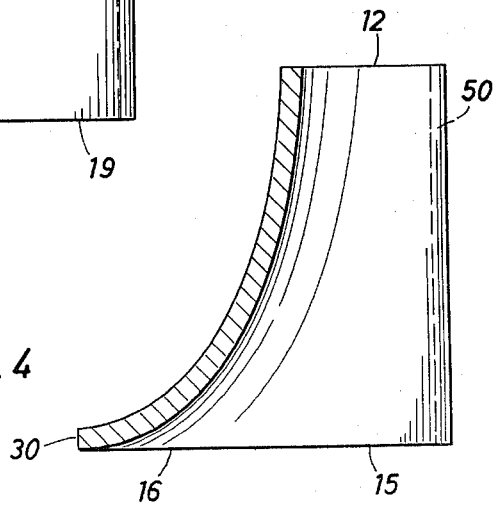

MODULAR BUILDING PANEL

REFERENCE TO CO-PENDING APPLICATION

Reference is made to co-pending design application Ser. No. 926,218, Filed July 19, 1978 in behalf of Samuel C. Crosby, the inventor of the subject matter in this disclosure.

BACKGROUND OF THE INVENTION

The present invention relates generally to a modular building panel, and more particularly to a building panel suitable for arrangement with other identical panels for forming the side walls of an enclosed structure.

Various modular panels have been developed in the past in an effort to reduce the cost of building materials. However, these prior modular panels have failed in significant respects to provide a system such that the panel can be arranged in an infinite number of ways to provide the wall portions of the dwelling and entranceways between rooms in the dwelling in a low-cost asthetically pleasing manner.

SUMMARY OF THE INVENTION

The present invention overcomes the prior art shortcomings in a building panel which, in one aspect of the invention, includes a three dimensional unitary structure having first and second ends. The first end has a surface configuration of approximately one quarter of a circle and the second end has a surface configuration comprised of a pair of surfaces converging toward each other. Those converging surfaces form a protuberance on that portion of the component, which can be used in conjunction with the same portion on another panel to form the entranceway into an enclosed structure. A first side on the building panel is disposed between the pair of converging surfaces of the second end, such that the first side is essentially flat and essentially parallel to a tangent to the mid point of the quarter circle of the first end. Second and third sides are respectively disposed between a terminus of one of the converging portions of the second surface and one of two terminii on the first end, such that each of the second and third sides are essentially perpendicular to the first and second ends. The body of the structure includes a wall having an essentially uniform thickness bounded by the first and second ends and also by the first, second, and third sides.

In a more limited aspect of the invention, each of the converging surfaces include a primary portion which then blends into a less severe converging section. More particularly, the primary converging surfaces may be straight surfaces which converge at an included angle of approximately 90°. Further, the less severe converging portions may be formed of arcs of a circle which terminate at the first side, such that the first side is essentially perpendicular to tangents to those arcs at the termination of the arcs. Even further, the centers of the two arcs may be located in a plane which includes the first side, such that the centers are also located on a line which is essentially parallel to the chord between the terminii of the first end surface.

In another aspect of the invention, the cross-sectional configuration of the panel taken along a plane perpendicular to the tangent at the mid point of the first end surface is essentially one half of a parabola whose origin is at said first side and extends to the first end.

In yet another aspect of the invention, the panel wall may have a configuration such that the cross-section along a series of parallel planes that are essentially perpendicular to the second and third sides varies from a quarter of a circle at the first end then through a series of progressively increasing parabolas to the configuration of the second end.

Preferably, both of the end surfaces along with the second and third sides have widths essentially identical to the thickness of the wall.

Most preferably, the second and third sides are contained in essentially perpendicular planes, such that the second side of a panel may be placed in contact with the third side of another panel to form the walls of the desired, enclosed structure.

Accordingly, the present invention provides several significant advantages over previously existing panels, as follows:

First, the panel of this invention may be used to create both the interior and exterior walls of an enclosed structure.

Second, the panel may be arranged in an infinite number of arrangements to create different floor plans and different exterior appearances. This could be very important for low-cost builders forming a subdivision in order to avoid similar appearing exteriors on the homes.

Third, the panel can be used not only to provide a wall, but can also be inverted to create an archway to enter the enclosed structure or to provide a passageway from one room to another within the structure.

Fourth, the panel lends itself to formation by a variety of building materials, which may be low-cost, light weight, and include good insulating characteristics.

Fifth, the panel also lends itself to forming low-cost dwellings, such as condominiums, by indefinitely combining and extending the components to form different living regions.

Sixth, the building panel may be stacked with other identical panels for facilitating their transport.

In summary, the building panel of the present invention combines aesthetic characteristics with low-cost and versatility.

These and other meritorious features and advantages will be more fully appreciated from the following detailed description and the appended claims.

BRIEF DESCRIPTION OF THE DRAWINGS

FIG. 1 is a top view of the building panel of this invention, as oriented in one of the two primary positions for use in forming enclosed structures.

FIG. 2 is a side elevational view of the building panel of this invention.

FIG. 3 is a frontal view of the panel of this invention, in the direction indicated by sectional symbol 3—3 in FIG. 1.

FIG. 4 is a cross-sectional view taken along plane 4—4 as shown in FIG. 1, illustrating the half parabolic cross-sectional configuration along the plane of symmetry of the building panel.

DETAILED DESCRIPTION OF THE PREFERRED EMBODIMENT

Figure 5:
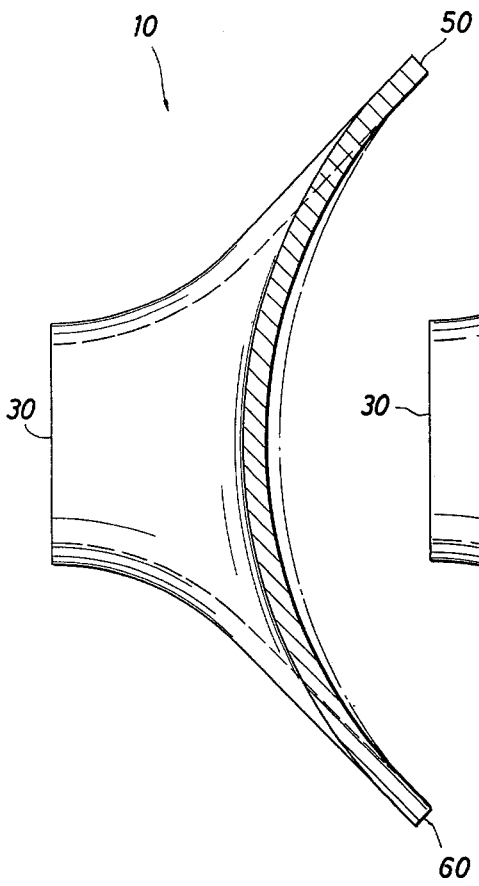
FIGS. 5, 6, and 7 are cross-sectional views taken along respective planes 5—5, 6—6, and 7—7 as shown in FIG. 2, to illustrate the progressively increasing parabolic cross-sectional configuration of the building component from its top to its bottom.

Referring now more particularly to the drawings, the building component 10 of this invention is shown as including a first end 12 which is essentially a quarter of a circle. A second end of the panel includes a pair of converging surfaces 14 and 18. These converging surfaces each respectively include a straight section 15 and 19 which each blend into a respective arcuate section 16, and 20. Most preferably, the included angle between straight sections 15 and 19 is 90°. The centers of the arcuate sections 16 and 20 are preferably located along a line included in the plane of a first side surface 30 of the panel. Moreover, the line interconnecting the center lines of these arcuate sections is essentially parallel to a tangent at the mid point of the quadrant surface 12 and also parallel to the chord across the two ends of the quadrant surface 12. Further, the tangent to these arcuate surfaces 16 and 20 at their point of termination at the first side surface 30 are perpendicular to that surface.

Figure 8:
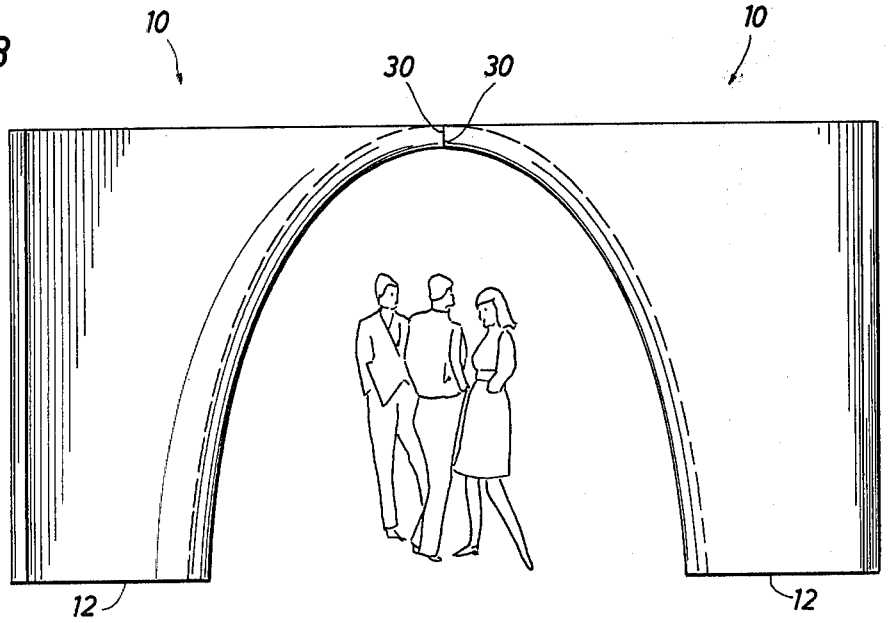
FIG. 8 is an elevational view illustrating an archway formed by inverting two of the panels.

As can be seen principally from FIGS. 1 and 2, the straight sections 15 and 19, along with the arcuate sections 16 and 20, form a protuberant region 40 that may be used when the panel is inverted from its position as shown in FIG. 2 to form an arched passageway. FIG. 4 shows the cross-section of the panel along a plane of symmetry as shown in FIG. 1 by section 4—4. This cross-sectional configuration is one half of a parabola, having an origin at the mid point of the first side 30 and then extending to the mid point of the quadrant surface 12. Therefore, a pair of panels 10 may be inverted and positioned such that their side surfaces 30 abut in order to form a parabolic-shaped passageway either into an enclosed structure or from one room to another in an enclosed structure. FIG. 8 illustrates such an arrangement.

The building panel further includes second and third side edges 50 and 60 which extend respectively between one terminus of the quadrant surface 12 to a terminus of the straight section 15 and between the other terminus of the quadrant surface 12 to the straight surface 19. Most preferably, each of the surfaces 50 and 60 are perpendicular to the respective surfaces 12–15 and 12–19 and are also included within planes which intersect at 90°. That is, surfaces 50 and 60 are contained in planes which similarly contain radii of the quadrant surface 12. This enables the panel 10 to be placed in engagement with another panel along these surfaces 50 and 60.

The body of the structure is illustrated as including a wall portion which is essentially uniform in thickness and extending from the first and second ends defined by surfaces 12, 15, 16, 19 and 20 and between the side surfaces 30, 50 and 60. Since surfaces 12, 15, 16, 19, 20, 50 and 60 are formed in planes perpendicular to the wall thickness at those regions, those surfaces have widths which are all the thickness of the wall section.

Figure 6:
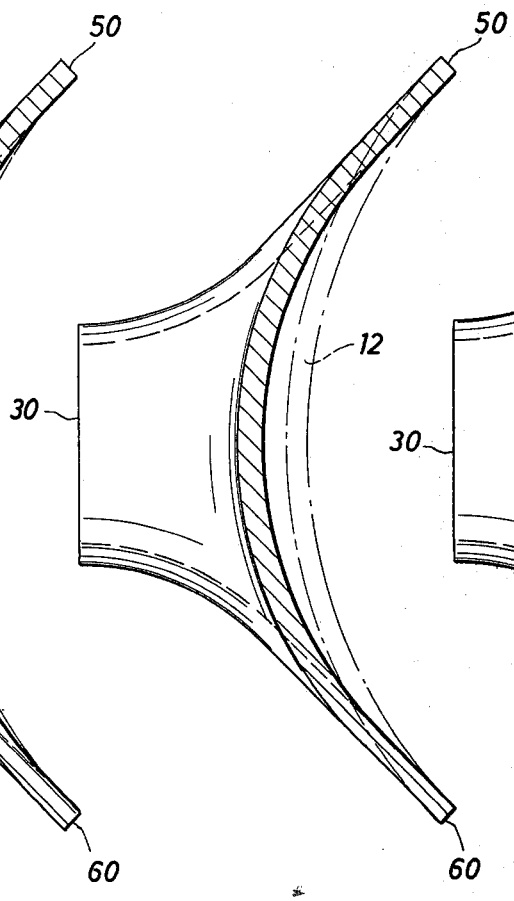
Figure 7:
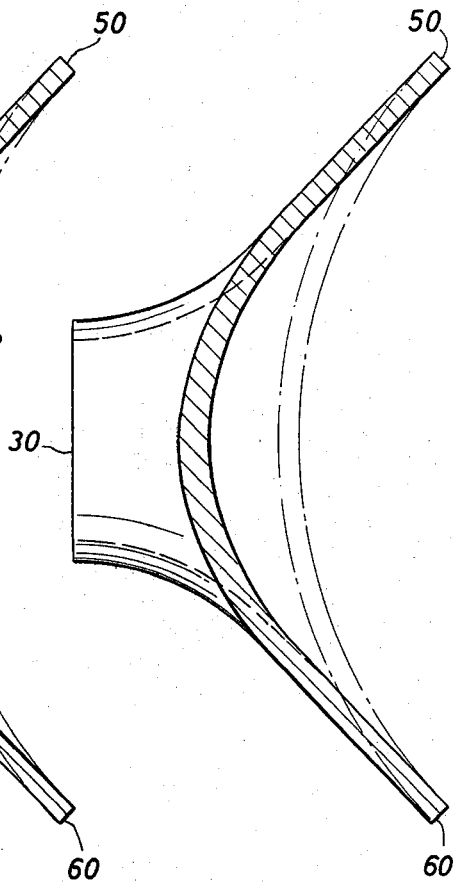

FIGS. 5, 6, and 7 illustrate a further feature of the present invention. That is, the cross-sectional configuration of the building panel 10 continuously and aesthetically blends by transition from surface 12 to the surfaces 14 and 18. This transition is from a configuration of a quadrant of a circle at surface 12 then through progressively larger parabolas in the series of parallel planes that are parallel to the surface 12 and perpendicular to the second and third sides 50 and 60. These cross-sectional parabolas then blend into the configuration of the straight and arcuate surfaces at the panel bottom.

It has been mentioned previously that the thickness of the wall is essentially uniform through the component. This does not appear to be so in FIGS. 5, 6, and 7, but this is because a portion of that cross-section is not perpendicular to a tangent of the panel at the point of intersection. Reference to FIGS. 2 and 4 illustrates the uniform wall thickness through plane 4—4, which becomes distorted by the inclination of the sections taken by FIGS. 5–7.

Preferably, the building module 10 will be sized such that it can be readily used for arrangement with other identical modules to form a residential dwelling, an office space, or any other enclosed structure. For example, the wall thickness may be on the order of six inches, the distance from the top surface 12 to the bottom surfaces 14 and 18 may be on the order of nine feet, the lateral distance between surface 30 and the edge of surfaces 50 or 60, as viewed in the plane of FIG. 2, may be on the order of about nine feet, and the distance between the tips of edges 50 and 60, as viewed in the plane of FIG. 1, may be on the order of approximately eighteen feet. Further, the radius of arcs 16 and 20 may be on the order of six feet, whereas the radius of the quadrant surface 12 may be on the order of twelve and a half feet. Obviously, these dimensions may be modified as desired, either proportionately or disproportionately. If the dimensions are modified disproportionately in the vertical direction, the basic characteristics of the module will remain the same, but the shapes of these features will be modified slightly.

Figure 9:
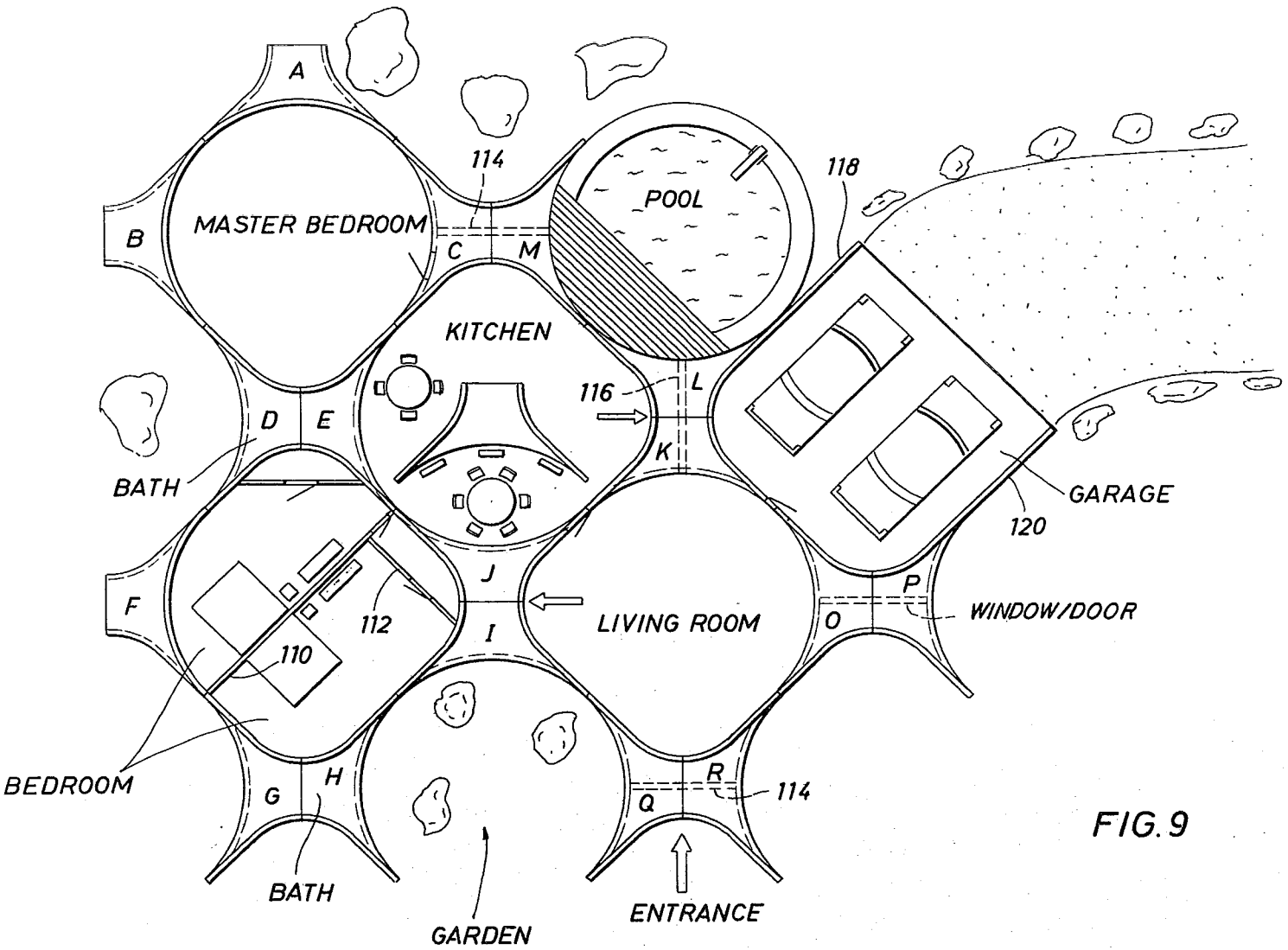
FIG. 9 is a proposed floor plan by arranging seventeen of the building panels of this invention in a manner to form an enclosed residence having on the order of 3,000 square feet of living area.

FIG. 9 illustrates one of an infinite number of ways of arranging modules 10 to form a floor plan. In the floor plan of FIG. 9, seventeen modules are used in combination to form the walls of the structure, with an eighteenth module being employed as a room divider.

FIG. 9 illustrates that first and second panels A and B are positioned as oriented in FIG. 2, to form 180° of the indicated master bedroom. Another module C is positioned in an inverted position with one of its side edges in an abutting relationship to a corresponding side edge of module A to form another portion of the wall section of the master bedroom; whereas additional panels D and E are similarly inverted in the manner shown in FIG. 8 to form an archway at one end of the master bedroom. Rather than that archway being a passageway into the master bedroom, in this particular case that area is used to form part of a bathroom between the master bedroom and another living area formed by panels F, G, H, I, and J. That particular living area is divided by a partition 110 to form two separate bedrooms.

As shown, the arch formed by the inverted sections G and H can again be used for a bath area. The arch formed by inverted panels I and J forms a passageway into the bedroom area just described, with a separate partition 112 being provided to form a hallway to separate the two bedroom areas.

Inverted panels K, L, and M are arranged with panels C, E, and J to form a kitchen and formal dining area which are separated by a separate panel N that serves as a room divider. A separate wall 114 is provided under the archway formed by inverted panel C and M to close that area off from the outside of the structure. A door or window can, obviously, be provided in that wall 114. Similarly, a separate wall 116 can be provided under the archway formed by mating, inverted panels K and L, with a door being provided in that wall to provide access from the kitchen area to a garage area. That garage area is formed by the inverted panels K and L and additional inverted panels O and P. Straight wall sections 118 and 120 extend from the straight sections at edges corresponding to surfaces 50 and 60 in FIGS. 1–7, to form the remainder of the garage. Accordingly, it can be seen that the straight sections on the bottom surface of the module can be put to significant advantage.

Other panels Q and R are provided to abut respectively against the edges of panels I and O to form the walls of the living room and foyer area. A separate wall section 124 is provided under the archway of inverted mating modules Q and R in order to close off the living room area to the outside and to provide an entranceway.

The exterior wall surface of the modules inherently provide areas for gardens and pools, as indicated. Of course, it will be apparent that the modules can be rearranged in any manner to achieve the desired floor plan. Moreover, the panels can be arranged to provide condominium areas and business office areas. A roof area can be provided for these structures as desired. It will be noted that the panels of this invention reduce the area requiring a roof, specifically in the region of the archways. For example, in the region formed by the archway of inverted panels I and J, the exterior surface on panel I need not be roofed.

It will be apparent to those skilled in the art that various modifications may be made to the disclosed embodiment, without departing from the true spirit of the invention, which is limited only by the following claims.

Having therefore completely and sufficiently disclosed my invention, I now claim:

1. A modular building component suitable for use with a plurality of such components for forming the side walls of a structure, comprising:

a three-dimensional unitary structure including opposed first and second ends, the first end having a surface configuration of approximately one quarter of a circle and the second end having a surface configuration comprised of a pair of essentially straight surfaces converging toward each other at an included angle of approximately 90°, said converging surfaces then each blending into an arc of a circle such that the arcs terminate at a first side of the component, the center of the two arcs being located in a plane which includes the first side, and the first side being comprised of a flat, essentially straight surface which is essentially perpendicular to tangents to the arcs at the termination of the arcs, second and third sides being respectively disposed between a terminus of the first end and the terminus of one of the essentially straight surfaces of the second end, with each of said sides being essentially perpendicular to the first and second ends, the body of the structure including a wall having an essentially uniform thickness bounded by said first and second ends and by the first, second, and third sides.

2. The component as defined in claim 1, wherein both of said end surfaces and said second and third sides have widths essentially identical to the thickness of the wall.

3. The component as defined in claim 1, wherein the cross-sectional configuration of the component taken along a plane perpendicular to the tangent at the mid point of the first end surface is essentially one half of a parabola whose orgin is at the mid point of said first side and extends to said first end.

4. The component as defined in claim 3, wherein the cross-sectional configuration of the component taken along a series of parallel planes that are essentially perpendicular to the second and third sides varies from the quarter of a circle at said first end then through a series of progressively increasing parabolas to the configuration of said second end.

5. The component as defined in claim 4, wherein said second and third sides are contained in essentially perpendicular planes.

6. A modular building component suitable for use with a plurality of such components for forming the side walls for structures, consisting essentially of:

a three-dimensional unitary structure including opposed first and second ends, the first end having a surface configuration of approximately one quarter of a circle and the second end having a surface configuration comprised of a pair of essentially straight surfaces converging toward each other at an included angle of approximately 90°, said converging surfaces then each blending into an arc of a circle such that the arcs terminate at a first side of the component, the first side being comprised of a flat, essentially straight surface which is essentially perpendicular to tangents to the arcs at the termination of the arcs, second and third sides being respectively disposed between a terminus of the first end and the terminus of one of the essentially straight surfaces of the second end, with each of said sides being essentially perpendicular to the first and second ends, the body of the structure including a wall having an essentially uniform thickness bounded by said first and second ends and by the first, second, and third sides.

7. A building panel, comprising:

a three-dimensional unitary structure having (a) a first end with a surface configuration of approximately one quarter of a circle, (b) a second end having a surface configuration comprised of a pair of primary surface portions which converge toward each other and then each blend into a less severe converging section which together form (c) a protuberance on the component, (d) a first side disposed between said less severe converging sections of the second end, wherein the surface of said first side is essentially flat and essentially parallel to a tangent to the mid point of the quarter circle of the first end, (e) second and third sides being respectively disposed between a terminus of one of the primary surface portions of the second surface and one of two terminii on the first end, wherein each of said second and third sides are essentially perpendicular to the first and second ends, (f) the body of the structure including a wall having an essentially uniform thickness bounded by said first and second ends and by first, second and third sides.

8. The building panel as defined in claim 7, characterized by the primary converging portions of the second end being essentially straight surfaces which converge at an included angle of approximately 90°.

9. The building panel as defined in claim 8, wherein the less severe converging portions of the second end are arcs of a circle which terminate at said first side, and such that the first side is essentially perpendicular to tangents to the arcs at the termination of the arcs.

10. The building panel as defined in claim 9, wherein the cross-sectional configuration of the panel taken along a plane perpendicular to the tangent at the mid point of the first end surface is essentially one half of a parabola whose origin is at said first side and extends to said first end.

11. The panel as defined in claim 10, wherein the cross-sectional configuration of the component taken along a series of parallel planes that are essentially perpendicular to the second and third sides varies from the quarter of a circle at said first end then through a series of progressively increasing parabolas to the configuration of said second end.

12. The panel is defined in claim 9, characterized by the center of the arcs being located on a line which is essentially parallel to the chord between the terminii of the first end surface.

13. A building panel, consisting essentially of:

a three-dimensional unitary structure having (a) a first end with a surface configuration of approximately one quarter of a circle, (b) a second end having a surface configuration comprised of a pair of surfaces converging toward each other to form (c) a protuberance on the component, (d) a first side disposed between said pair of converging surfaces of the second end, wherein the surface of said first side is essentially flat and essentially parallel to a tangent to the mid point of the quarter circle of the first end, (e) second and third sides being respectively disposed between a terminus of one of the converging portions of the second surface and one of two terminii on the first end, wherein each of said second and third sides are essentially perpendicular to the first and second ends, (f) the body of the structure including a wall having an essentially uniform thickness bounded by said first and second ends and by first, second and third sides.

* * * * *